US005321793A

United States Patent [19]

Drogo De Iacovo et al.

[11] Patent Number: 5,321,793

[45] Date of Patent: Jun. 14, 1994

[54] LOW-DELAY AUDIO SIGNAL CODER, USING ANALYSIS-BY-SYNTHESIS TECHNIQUES

[75] Inventors: Rosario Drogo De Iacovo, Rocco Imperiale Marina; Roberto Montagna; Daniele Sereno, both of Turin, all of Italy

[73] Assignee: SIP—Societa Italiana per L'Esercizio delle Telecommunicazioni P.A., Turin, Italy

[21] Appl. No.: 65,990

[22] Filed: May 21, 1993

[30] Foreign Application Priority Data

Jul. 31, 1992 [IT] Italy ..... 000658 A/92

[51] Int. Cl.[5] ..... G10L 9/14

[52] U.S. Cl. ..... 395/2.29; 395/2.28

[58] Field of Search ..... 381/38, 30; 395/2.29, 395/2.28

[56] References Cited

U.S. PATENT DOCUMENTS 5,233,660 8/1993 Chen ..... 381/38

FOREIGN PATENT DOCUMENTS

0396121A1 11/1990 European Pat. Off. .

OTHER PUBLICATIONS

High-Quality 16 KB/S Speech Coding . . . by Juin-Hwey Chen published 1990 IEEE.

Some Experiments of 7 KHZ Audio Coding At 16 KBIT/S by Drogo de Iacovo et al., published 1989 IEEE.

Adaptive Lattice Analysis Of Speech, by J. I. Makhoul et al., published 1981 IEEE Draft Recommendation G.72X "Coding Of Speech at 16 KBIT/S Using Low-Delay Code Excited Linear Prediction".

GSM Recommendation: 06.10 "GSM full Rate Speech Transcoding" Sept. 19, 1988.

*Primary Examiner*—Allen R. MacDonald
*Assistant Examiner*—Richard J. Kim
*Attorney, Agent, or Firm*—Herbert Dubno

[57] ABSTRACT

A low-delay audio signal coding system, using analysis-by-synthesis techniques, has circuitry for adapting the spectral parameters and the prediction order of synthesis filters, and of perceptual weighting filters in the order at each frame, starting from the reconstructed signal relevant to the previous frame. In the case of a CELP coder, gain controls are also provided to adapt, starting from the reconstructed sinal, a factor, bound to the average power of the input signal, of the gain by which the innovation vectors are weighted.

13 Claims, 4 Drawing Sheets

LOW-DELAY AUDIO SIGNAL CODER, USING ANALYSIS-BY-SYNTHESIS TECHNIQUES

Our present invention relates to audio signal coding systems and, more particularly, to a low-delay coding system using analysis-by-synthesis techniques. The system is preferably meant for coding wideband audio signals.

BACKGROUND OF THE INVENTION

The term "wideband" is used in the speech coding field to indicate that the signal to be coded has a bandwidth greater than the about 3 kHz bandwidth of the conventional telephone band, in particular a band between about 50 Hz and 7 kHz. The use of a wider band than the conventional telephone band allows a higher quality of the coded signals to be obtained, as required or desired for certain services offered by integrated service digital networks, such as audioconference, videophone, commentary channels, etc., and also for cordless telephones.

In cases in which the coded signal must be transmitted at relatively low bit rates (for example 16–32 kbits/s), the use of the analysis-by-synthesis coding technique has already been suggested. This technique gives the highest coding gains at these rates. In particular, the paper "Experiments on 7 kHz audio coding at 16 kbits/s", presented by R. Drogo de Iacovo et al. at ICASSP '89, Glasgow (UK), 23–26 May 1989, paper S4.19, and European Patent Application EP-A-0 396 121, disclose a system in which the signal to be coded is divided into two sub-bands whose signals are coded at the same time, and examples are supplied of coders in which a multipulse excitation or an excitation consisting of vectors selected in an appropriate codebook (CELP=Codebook Excited Linear Prediction technique) is exploited.

In this known system, the coders of the two sub-bands operate on sample groups or frames with a 15–20 ms duration, and this clearly implies a coding delay at least equal to the duration of the frames themselves. For certain applications, such as cordless telephones, audiographic conferences, etc., it is essential to have a low-coding delay, so as to reduce the effects of acoustical and electrical echoes. To obtain the low delay, in schemes such as that shown in this European Patent Application, one cannot resort only to the use of very short frames (a few ms), because this would necessitate frequent updating of coding parameters, with a consequent increase in information to be transmitted to the decoder and therefore in the bit rate.

To realize low-delay coders using short-duration frames, without increasing the bit rate, it has been suggested to use CELP techniques in which the spectral parameters are computed starting from the signal reconstructed at the transmitter ("backward" CELP technique). According to these techniques, for each frame, the prediction units receive the set of parameters determined in the previous frame, estimate at each new sample a possible updated value of parameters, and supply as actual values those estimated after receiving the last sample. An example of this type of low-delay coder is described in the CCITT draft Recommendation G728 "Coding of Speech at 16 kbit/s Using Low-Delay Code Excited Linear Prediction" and in the paper "High-quality 16 kb/s speech coding with a one-way delay less than 2 ms", presented by J. H. Chen at ICASSP '90, Albuquerque (USA), April 3–6, paper S9.1. In this coder, designed for coding audio signals with the conventional telephone band, backward adaptation techniques are used to update predictor coefficients in the synthesis filters (comprising only short-term predictors) and the gain with which excitation vectors are scaled In particular, predictor coefficients of the synthesis filters are updated by means of an LPC analysis of the previously quantized speech; the coefficients of the weighting filters are updated by means of an LPC analysis of the input signal; and the vector gain is updated by using the gain information incorporated in the previously quantized excitation. In this way only the index of the word in the codebook (structured in excitation gain and shape) must be transmitted, since the predictor coefficients of the synthesis filter and the backward adapted gain can be determined in the receiver by backward adaptation circuits similar to those used in the transmitter.

The quality loss which could occur as a result of dispensing with a long-term predictor is compensated for by the use of a relatively high prediction order for the short-term predictors, in particular a prediction order equal to 50. In any case, the short-term prediction order cannot be raised beyond a certain limit for reasons of computation complexity.

In the case of sub-band coding, the use of different prediction orders in the different sub-bands has been suggested. In particular, in the coder described in the said paper by R. Drogo de Iacovo et al. (in which long-term correlations are exploited) filters with prediction order 10 for the lower sub-band and order 4 for the upper sub-band are used. These prediction orders are fixed. Good results are obtained in this way for actual speech, but not for signals with highly variable characteristics, such as music.

OBJECT OF THE INVENTION

The object the invention is to provide a low-delay coder in which a good-quality reconstructed signal is obtained even when input signals exhibit highly variable characteristics.

SUMMARY OF THE INVENTION

According to the invention, an analysis-by synthesis audio coding-decoding method is provided wherein, at the coding end, the synthesis filtering for the set of the excitation signals and the perceptual weighting filtering of the input signal and of the synthesized signals are carried out by adapting the spectral parameters of the synthesis and weighting filters with backward prediction techniques, starting from a reconstructed audio signal obtained as a result of the synthesis filtering of an optimum innovation signal, and, at the decoding end, the audio signal is reconstructed by subjecting the optimum innovation signal, identified in the coding phase, to a synthesis filtering during which the spectral parameters of the synthesis filter are adapted with backward prediction techniques, in a manner corresponding to the adaptation performed in the coding phase. Furthermore an adaptation of the prediction order of the synthesis filters is also carried out, at both the coding and decoding ends, as is an adaptation of spectral weighting filters at the coding end, starting from the spectral characteristics of the reconstructed signal.

In a preferred embodiment, the adaptation of the prediction order includes the following operations:

a) calculating, as a function of the prediction order and up to a predetermined maximum order, the prediction gain of the synthesis filters, obtained from reflection coefficients of the acoustic tube, and the incremental prediction gain of the same filters when the prediction order increases by one unit, said gains being given respectively by the relations:

$$G(p) = 1/\prod_{J=1}^{p}(1 - KJ^2)$$

$$G(p/p-1) = \prod_{J=1}^{p-1}(1 - KJ^2)/\prod_{J=1}^{p}(1 - KJ^2)$$

where KJ are the reflection coefficients of the acoustic tube;

b) determining, in a prediction order interval between a minimum order and said maximum order, the values for which the incremental prediction gain G(p/p−1) presents a relative maximum and is greater than a first predetermined threshold;

c1) performing weighting and synthesis filtering by using the highest prediction order among those determined in step b), if the prediction gain corresponding to the maximum prediction order is greater than or equal to a second predetermined threshold; and c2) performing weighting and synthesis filtering by using the minimum prediction order, if the prediction gain corresponding to the maximum prediction order is lower than the second threshold.

According to a preferred future of the invention, spectral parameter adaptation is carried out with lattice techniques. These techniques exhibit reduced sensitivity to errors in finite arithmetic implementation and an easier control of filter stability; they also facilitate the adaptation of the prediction order.

Preferably, the coding technique is a CELP technique, in which an adaptation with backward prediction techniques of the vector gain is also performed.

Advantageously, the signal to be coded is divided into a certain number of sub-bands, and the coding method according to the invention is employed in each of these sub-bands. The sub-band structure allows a reduction in computation complexity and a better shaping of the quantization noise.

In this case, it is preferred to dynamically allocate the available bits among the various sub-bands, according to a technique which takes the characteristics of weighting filters into account.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
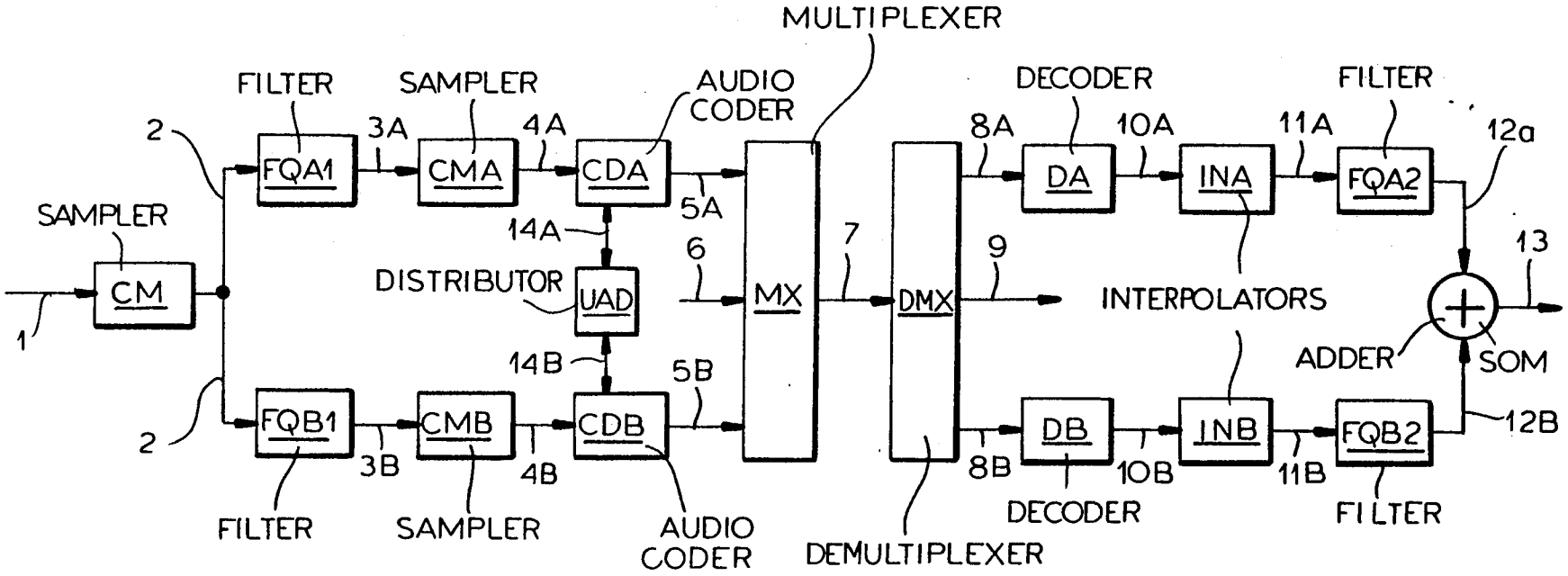
FIG. 1 is a block diagram of a wideband speech coding system which uses the invention.

FIG. 1 shows a system for coding audio signals with 7 kHz band by dividing the signal into two sub-bands, of the type described in EP-A-0 396 121. The 7 kHz band signal, present on line 1 and obtained by means of appropriate analog filtering in filters not shown, is supplied to a first sampler CM operating for example at 16 kHz, whose output 2 is connected to two filters FQA1 and FQB1, one of which (for example FQA1) is a highpass filter while the other is a lowpass filter The two filters have basically the same bandwidth.

Through connections 3A and 3B the filters FQA1 and FQB1 send the signals of the respective sub-band to samplers CMA and CMB, which operate at Nyquist rate for such signals, i.e. 8 kHz, if the sampler CM operates at 16 kHz. The samples thus obtained are supplied through connections 4A and 4B to audio coders CDA and CDB which use analysis-by-synthesis techniques. Coded signals, present on connections 5A and 5B, are sent to transmission line 6 through units, schematized by multiplexer MX, which allow the introduction onto the line of other potential signals (for example video signals), if any, present on connection 7.

At the other end of line 6 a demultiplexer DMX sends, through connections 8A and 8B, the coded audio signals to decoders DA and DB which reconstruct the signals of the two sub-bands. The processing of the other signals, emitted on output 9 of DMX, is of no interest for the present invention, and therefore units designed for such processing are not shown. Outputs 10A and 10B of DA and DB are connected to the respective interpolators INA and INB, which reconstruct the signals at 16 kHz. These signals are in turn supplied, through connections 11A and 11B, to filters FQA2 and FQB2 (analogous to filters FQA1 and FQB1), which eliminate aliasing distorsion of the interpolated signals. Filtered signals relative to the two sub-bands, present on connections 12A and 12B, are then recombined to produce a signal with the same band as the original signal (as schematized by adder SOM) and sent through a line 13 to the utilization devices According to the invention coders CDA and CDB, for the reasons stated above, are low-delay coders, able to operate with frames lasting only few ms. In the practical embodiment of coders according to the invention, for transmissions at 16 kbit/s, frames of 10 or 20 samples are used which, at the sampling rate 8 kHz indicated for the samplers CMA, CMB, correspond to 1.25–2.5 ms of audio signal.

Coding bits can be allocated to the two sub-bands in a fixed manner: in an example of embodiment, a 10-sample frame is used for the lower sub-band, coded at 12 kbit/s, and a 20-sample frame for the upper sub-band, coded at 4 kbit/s.

Allocation can take place dynamically, so as to take account of the nonstationary nature of audio signal. In this second case, coders CDA and CDB are connected through connections 14A and 14B to a unit UAD which, according to the invention, distributes the bit between the two sub-bands so as to minimize the total distortion, taking account also of the presence of spectral weighting filters in the coders. The allocation procedure is the following.

Total distortions can be given by D=D1+D2, where D1 and D2 are the distortions relating to the individual sub-bands that, as already known, depend on the power of the residual signal. In an analysis-by-synthesis coder, in which a spectral weighting of the input signal is effected, the distorsion is influenced by such weighting and can be approximated by the relation:

$$D_i = 2^{-b_i}\sigma_i \int_{-\pi}^{\pi} |W_i^{-1}(\omega)| d\omega/2\pi \qquad (i = 1,2)$$

where $b_i$ is the number of bits assigned to sub-band i, $\sigma_i$ is the mean-square value (power) of the residual signal of sub-band i, and $W_i^{-1}(\omega)$ is the inverse of the transfer function of the spectral weighting filter, expressed as a function of the angular frequencies $\omega$. Using $X_i$ to represent the product $$\sigma_i \int_{-\pi}^{\pi} |W_i^{-1}(\omega)| d\omega/2\pi,$$

it can be immediately deduced that the total distorsion is minimized by assigning a number of bits $b_i$ to sub-band i, given by $$b_i = R/2 + \log_2 \frac{X_i}{\left(\prod_{i=1}^{2} X_i\right)^{\frac{1}{2}}}$$

where R is the total number of bits. A person skilled in the art has no difficulty in designing a circuit capable of determining $b_i$ by applying the above relation.

In a practical example of a coder with dynamic bit allocation to the two sub-bands, each sub-band could operate at bit-rates which vary from 12 to 4 kbit/s by steps of 1.6 kbit/s; a 10-sample frame has been adopted for the sub-band transmitted at rates greater than or equal to 8.8 kbit/s, and a 20-sample frame for the sub-band transmitted at rates less than or equal to 7.2 kbit/s.

Figure 2:
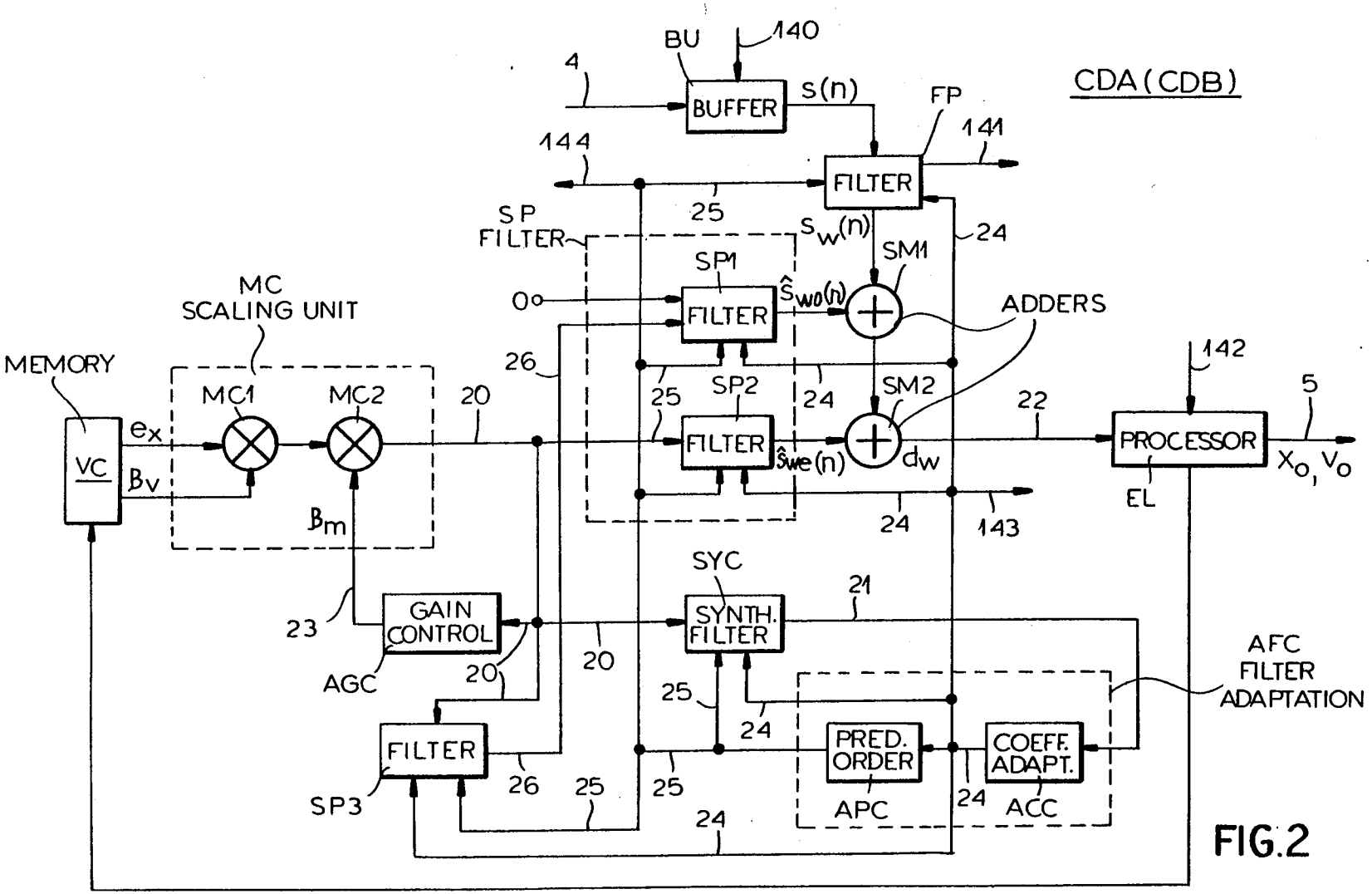
FIG. 2 is a block diagram of the coder according to the invention.

FIG. 2 shows the scheme of one of the blocks CDA and CDB of FIG. 1 in the case, given by way of non limiting example, that the coding is done with the CELP technique. Given that the different analysis-by-synthesis coding techniques essentially differ only for the nature of the innovation signal, a person skilled in the art would have no difficulty in applying what is described here to a technique different from the CELP technique. In the scheme chosen, the long-term synthesis is not done, so as to keep the algorithmic complexity low, and there is an adaptation with backward prediction techniques both of the coefficients of the synthesis and weighting filters and of the gain. Moreover, the prediction order of synthesis and weighting filters is also adapted.

That being stated, the signal to be coded, in digital form, is organized into vectors consisting of the desired number of samples (for example 10–20, as said before) in a buffer BU. In the case of dynamic allocation of the coding bits, in which the choice of the frame length depends on the bit rate, buffer BU will be controlled by unit UAD (FIG. 1) through line 140, forming a part of connection 14A or 14B of FIG. 1. Each vector s(n) is spectrally shaped in the perceptual weighting filter FP (FIG. 2) typical of all analysis-by-synthesis coding systems. During this weighting operation, as a known, a linear prediction inverse filtering is carried out which supplies the residual signal, supplied to UAD through line 141, likewise forming a part of the connection 14A or 14B of FIG. 1. Each weighted input vector $s_w(n)$, after subtracting the contribution $s_{w0}$ of the memory of the previous filterings, is compared with all of the vectors obtained by filtering the E vectors $e_x$ of the innovation codebook (stored in a memory VC), in the cascade of a short-term synthesis filter and of a weighting filter, such vectors being scaled with an appropriate gain in a scaling unit MC. Upon completion of these comparisons, the innovation vector—gain combination which minimizes the mean-squared error between the original signal and the synthesized signal is determined. The scaled vectors are fed to the cascade of the two filters through a connection 20. The number E of the vectors used in a frame depends on the number of bits allocated to the sub-band in that frame.

The weighting filter FP has transfer function W(z) usually expressed as $W(z)=A(z)/A(z/\gamma)$ (where $0 \leqq \gamma \leqq 1$ is the perceptual weighting factor, which takes account of how the human ear is sensitive to noise). The short-term synthesis filter has transfer function $H(z)=1/A(z)$. The expression of functions A(z) and $A(z/\gamma)$ depends on the filter structure: in particular, if the filters are recursive filters, A(z) and $A(z/\gamma)$ are the conventional functions of the linear prediction coefficients $$A(z) = 1 + \sum_{i=1}^{p} a_i \cdot z^{-i}, \; A(z/\gamma) = 1 + \sum_{i=1}^{p} a_i \cdot \gamma^i \cdot z^{-i}$$

where $a_i$ are the linear prediction coefficients and p is the filter order; if the filters are lattice filters, A(z) and $A(z/\gamma)$ are functions of the reflection coefficients of the acoustic tube and are determined, for example, as described in CEPT/GSM Recommendation 06.10, in which the structure of filters with transfer function A(z) and 1/A(z) is reported for the case p=8.

The application of what described in this Recommendation for the cases of any order p and of the function $A(z/\gamma)$, is commonplace for a person skilled in the art. With the transfer functions mentioned above, the cascade of the synthesis filter and of the weighting filter through which the scaled innovation vectors are made to pass will be equivalent to a single filter SP (weighted short-term synthesis filter) with transfer function $1/A(z/\gamma)$.

For the determination of the error signal, as said before, the contribution of the memory of the excitation signal filterings effected in the previous frames is subtracted separately from the input signal, outside the analysis-by-synthesis loop. The single filter SP is thus schematized with two parallel and equal filters, SP1 and SP2. The first of these two filters has null input and loads, for each vector s(n) to be coded, the signal present on output 26 of a weighted short-term synthesis filter SP3, also having transfer function $1/A(z/\gamma)$, that receives, at the end of the search procedure of optimal excitation, the optimum vector scaled with the optimum gain, present on output 20 of MC; the output signal of SP1 is the signal $\hat{s}_{w0}$ previously mentioned. The second filter SP2, on the other hand, performs the actual filtering without memory of the scaled vectors Filter SP3, with memory VC and scaling unit MC, forms a simulated decoder used to update the memories of filter SP1. A further short-term synthesis filter SYC is also provided, with transfer function 1/A(z); this filter also receives, at the end of the search procedure of optimal excitation, the optimum vector scaled with the optimum gain and forms, with memory VC and scaling unit MC, a simulated decoder used for adapting the spectral parameters and the filter prediction order of the decoder.

The output signal $\hat{s}_{w0}(n)$ of SP1 is subtracted in an adder SM1 from output signal $s_w(n)$ of FP, and the output signal $\hat{s}_{we}(n)$ of SP2 is subtracted in SM2 from the resulting signal. Output 22 of SM2 conveys signal dw (weighted error) which is then supplied to the processing unit EL which carries out all operations necessary for identifying the optimum vector and gain (i.e. the vector and gain which minimize the error). These operations are basically identical to those of conventional CELP coders. In the case of dynamic bit allocation to the sub-bands, EL will receive from UAD, through connection 141, likewise forming a part of the connection 14A or 14B of FIG. 1, the information about the number of bits allotted to the excitation in that frame, i.e. an information concerning the number of vectors among which the search is to be affected in that frame.

The gain scaling unit MC is associated with a gain adaptation unit AGC, and filters FP, SP1, SP2, SP3, SYC are connected to a filter adaptation unit AFC. These adaptation units operate according to backward prediction techniques, obtaining the value to be used in a frame for the respective quantity from the synthesized signal relative to the previous frame.

The gain consists of the product of two factors $\beta_m$ and $\beta_v$. The first factor, $\beta_m$, takes account of the average power in the signal and is supplied by AGC through connection 23. AGC receives through connection 20 the optimum excitation vector, scaled with the relative total optimum gain, and derives therefrom the value $\beta_m$ to be used for coding the next vector, by using a method like that described by J. I. Makhoul and L. K. Cosell in "Adaptive Lattice Analysis of Speech", IEE Transactions on Acoustics, Speech and Signal Processing, Vol. ASSP-29, No. 3, Jun. 1981. Factor $\beta_v$ is typical of the vector and is selected from an appropriate gain codebook, as in conventional CELP coders; this factor will therefore be concerned by the search for the optimum excitation, so that the coded signal will consist of indexes xo and $v_o$ of the vector $e_x$ and respectively of the optimum factor $\beta_v$. For drawing simplicity, the memory storing the gain codebook is incorporated into memory VC storing the excitation vectors $e_x$.

The scaling unit MC will therefore include two multipliers, MC1 and MC2, in series with each other. The first multiplier effects the product by factor $\beta_v$, while the second effects the product by $\beta_m$, kept available for MC during the whole search for the optimum excitation relative to a vector to be coded. It can be noted that in the described example, the number of available bits for coding $\beta_v$ is assumed to be constant, even in the case of bit dynamic allocation.

The filter adaptation unit AFC consists in turn of a series of two units: the first, ACC, adapts the filter coefficients, and the second, PAC, adapts the prediction order. In the present invention, filters FP, SP1–SP3, and SYC are lattice filters which directly use the reflection coefficients of the acoustic tube, and unit ACC derives these coefficients from the signal present on output 21 of filter SYC through the procedure described in said article by J. I. Makhoul and L. K. Cosell. The coefficients are supplied to the various filters through connection 24. In the case of dynamic bit allocation, the coefficients are also supplied to unit UAD (FIG. 1), through a branch 143 of connection 24, to update the function $W_i$ used for this allocation. This branch forms part of connection 14 in FIG. 1. This choice of filters is dictated, i.a., by the fact that the prediction order adaptation unit APC also makes direct use of the reflection coefficients, as will be described in greater detail below. In any case, other types of spectral parameters can be used.

Unit APC determines the value p of the prediction order to be used for a coding vector in an interval defined by a minimum prediction order and a maximum prediction order. The value found is supplied to the various filters through connection 25, whose branch 144 (forming part of connection 14 in FIG. 1) is connected to unit UAD (FIG. 1) for updating the value of p in $W_i$.

For this determination, the prediction gain of the synthesis filter SYC and the incremental gain obtained by increasing the prediction order of a unit are considered. The prediction order is defined, for any order p, by $$G(p) = 1/\prod_{J=1}^{p}(1 - KJ^2)$$

where KJ are the reflection coefficients determined by means of the prediction operation in ACC; the incremental gain is given by the ratio G(p)/G(p−1) and will thus be expressed by the relation $$G(p/p-1) = \prod_{J=1}^{p-1}(1 - KJ^2)/\prod_{J=1}^{p}(1 - KJ^2)$$

According to the invention, the prediction order to be used for all filters in the coder will be the highest value among the values of p for which the incremental gain is a local maximum and is greater than a predetermined first threshold T1, if the absolute gain corresponding to the maximum prediction order is not less than a second threshold T2; if this condition for the gain is not met, the prediction order used will be the minimum order.

The choice for the highest order among those for which the incremental gain exhibits a local maximum is based on the fact that the gain tends to increase along with the increase of the prediction order. Such a choice, therefore, ensures an optimum condition; the check on exceeding the threshold ensures that the greater computation complexity consequent to the choice of the high prediction order actually corresponds to a substantial improvement in performance.

The condition relative to the absolute gain serves to prevent a high prediction order from being used when the signal presents a relatively flat spectrum: in these conditions, the use of a high prediction order uselessly increases the computation complexity.

Suitable minimum values of the prediction order can be 10–15 for the lower sub-band and 5–8 for the upper sub-band; the maximum values can be 50–60 and 15–20, respectively. Suitable threshold values can range from 1.001 to 1.01 for the first threshold, and from 1 to 2 for the second threshold. These ranges are valid for both sub-bands. Preferably, values in the second half of these ranges are used. Each threshold can but it does not need to have the same value in both sub-bands.

Figure 4:
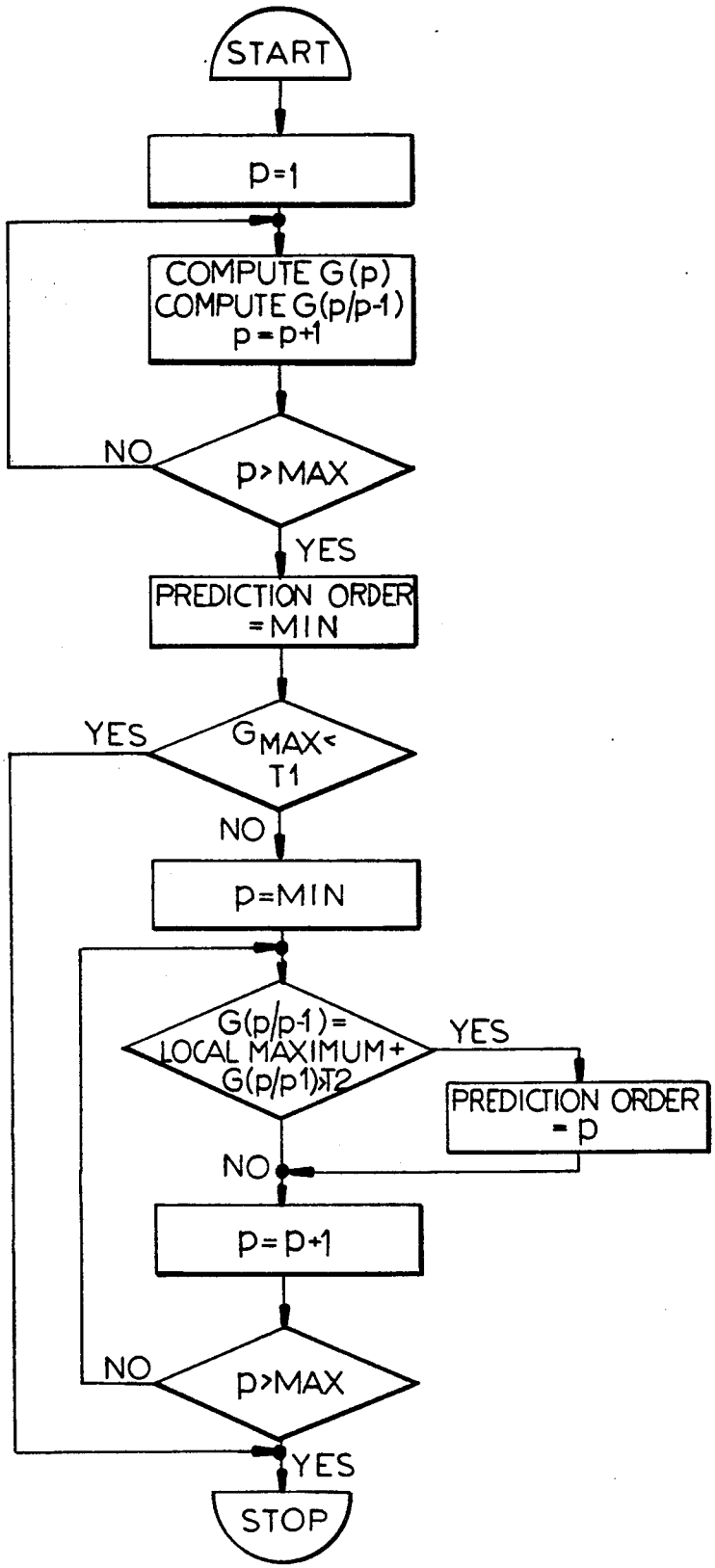
FIG. 4 is a flow diagram of the algorithm of prediction order adaptation.

The algorithm described above is presented in the form of a flow chart in FIG. 4, wherein:

MAX, MIN are respectively the maximum and minimum values of prediction order p;

$G_{MAX}$ is the prediction gain when p=MAX;

T1, T2 are respectively the above said thresholds.

A person skilled in the art has no difficulty in implementing the described algorithm, taking account, among other things, that the described functions are generally realized by means of digital speech processors.

Varying the filter prediction order corresponds solely to varying the number of coefficients to be used in mathematical operations corresponding to digital filtering.

Figure 3:
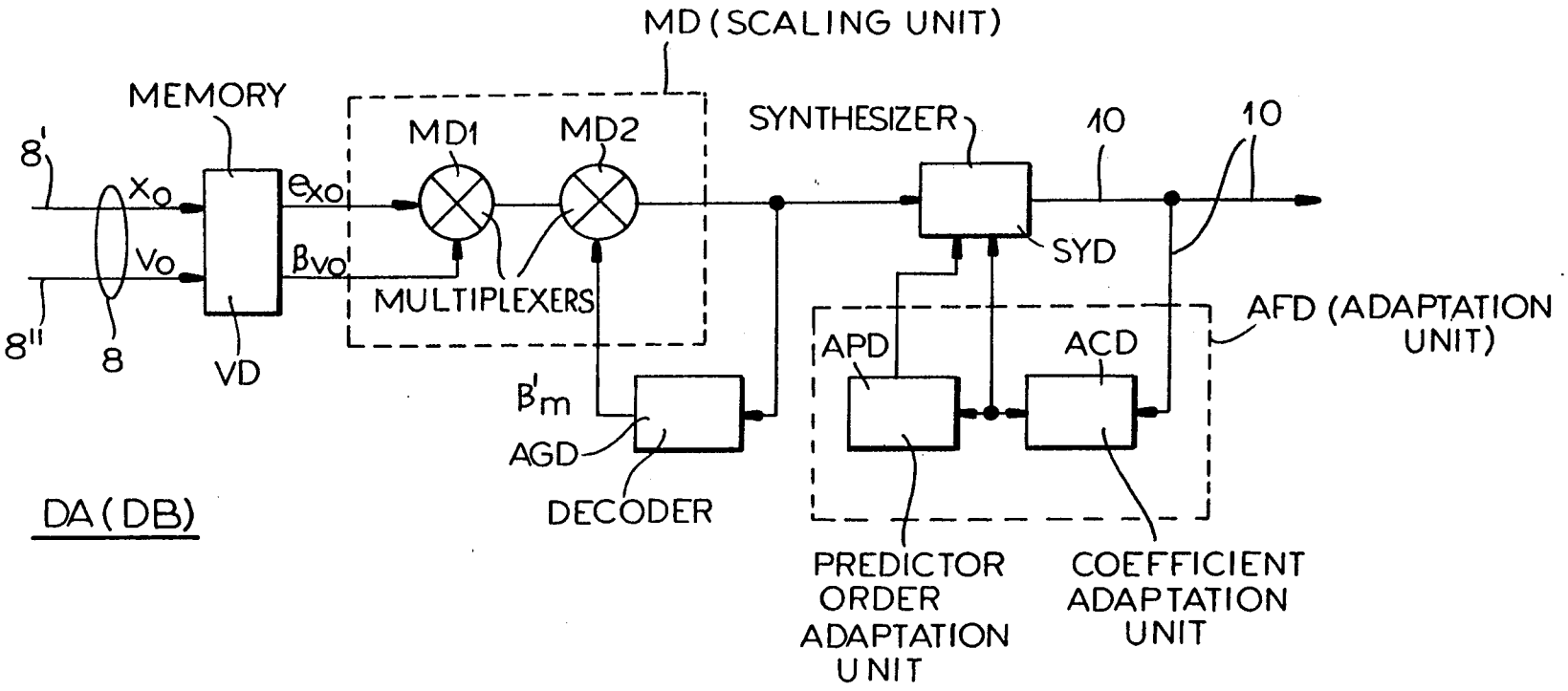
FIG. 3 is a block diagram of the decoder.

FIG. 3 shows the decoder structure, which corresponds to that of the simulated decoder present in the coder and includes:

memory VD, identical to memory VC (FIG. 2), addressed by indexes xo and vo of optimum gain factor and vector respectively, transmitted by the coder and present on wires 8' and 8" forming connection 8;

scaling unit MD, connected to the adaptation unit AGD operating in a manner similar to AGC, FIG. 2), and comprising multipliers MD1, MD2, corresponding to the multipliers of the coder scaling unit; these two multipliers will thus carry out the product of vector $e_{xo}$ read in VD, by the factor $\beta_{vo}$, also read in VD, and by the factor $\beta'_m$ adapted for every new signal to be decoded by unit AGD;

synthesizer SYD, connected to adaptation unit AFD, also including a coefficient adaptation unit ACD and a prediction order adaptation unit APD, which operate like ACC and APC (FIG. 2). In particular, unit APD will operate according to a program similar to that shown by the flow chart of FIG. 4, using for the maximum and minimum orders and for the thresholds the same values as used in the coder.

It is clear that what has been described has been given only by way of non limiting example, and that variations and modifications are possible without going out of the scope of the invention. So, for example, although the invention has been described with reference to CELP technique, the adaptation of the prediction order can be applied to any analysis-by-synthesis coding technique. Clearly, the gain adaptation will be effected only in the case of techniques in which the innovation for the synthesis filters consists of vectors. Furthermore, the invention can be applied even in cases in which the coding occurs on the whole 8 kHz band, and not on the partial sub-bands, or on a number of sub-bands other than two or in the case of signals having the conventional telephone band from 300 Hz to 3.4 kHz. In the case of more than two sub-bands, the considerations relative to the dynamic bit allocation can be immediately generalized.

We claim:

1. A method of coding and decoding audio signals by means of analysis-by-synthesis techniques wherein, at a coding end, in a coding phase, an audio signal is organized into blocks of digital samples and, for each sample block, a synthesis filtering is effected for a set of innovation signals ($e_x$) and perceptual weighting filtering of an input signal and of a synthesized signals of the analysis-by-synthesis are carried out by adapting spectral parameters of synthesis and weighting filter with backward prediction techniques, starting from a reconstructed audio signal obtained as the result of the synthesis filtering of an optimum one of the innovation signals, and, at a decoding end, the audio signal is reconstructed by submitting the optimum innovation signal ($e_{xo}$), identified in the coding phase, to a synthesis filtering during which the spectral parameters of the synthesis filter (SYD) are adapted by a backward prediction technique, in a manner corresponding to the adaptation carried out in the coding phase, said method further comprising, for each sample bock to be coded and for each signal to be decoded, an adaptation is also made of the prediction order of the synthesis filters, at both the coding and the decoding ends, and of the perceptual weighting filters at the coding end, based upon spectral characteristics of the reconstructed signal.

2. The method according to claim 1 wherein said adaptation of the prediction order is effected with the following operations:

a) calculating, as a function of the prediction order and up to a predetermined maximum order, the prediction gain of the synthesis filters which generate the reconstructed signal, and their incremental prediction gain when the prediction order is increased by one unit, said gains being given respectively by the relations:

$$G(p) = 1/\prod_{J=1}^{p}(1 - KJ^2)$$

$$G(p/p-1) = \prod_{J=1}^{p-1}(1 - KJ^2)/\prod_{J=1}^{p}(1 - KJ^2)$$

where KJ are the reflection coefficients of the acoustic tube;

b) determining, in a prediction order interval between a minimum order and said maximum order, the values for which the incremental gain G(p/p−1) presents a relative maximum and is greater than a first predetermined threshold;

c1) carrying out the synthesis and weighting filterings with the highest prediction order among those determined at point b), if the gain corresponding to the maximum prediction order is not less than a second predetermined threshold; and c2) carrying out the synthesis and weighting filterings using the minimum prediction order, if the gain corresponding to the maximum prediction order is less than a second predetermined threshold.

3. The method according to claim 1 wherein the adaptation of filter spectral parameters is performed with adaptive lattice techniques.

4. The method according to claim 1 wherein the innovation signals ($e_x$) consist of vectors that are scaled, before the synthesis filtering, with a gain consisting of a firs factor $\beta_v$ typical of the vector and of a second factor $\beta_m$ that takes account of the average power in the signal to be coded, and in that, for each block of samples to be coded or for each coded signal to be decoded, an adaptation of said second factor $\beta_m$ is also carried out, with adaptive lattice techniques, starting from the vector of the optimum innovation signal ($e_{xo}$), scaled with the total gain, identified for coding the previous sample block or used for decoding a previous signal.

5. The method according to claim 2 in which the signals to be coded are wideband signals and in which a band of the signals to be coded is divided into at least two sub-bands whose signals are coded separately, the coding bits being dynamically allocated to the various sub-bands so as to minimize the overall distortion, taking account of the distortion introduced by the perceptual weighting filtering.

6. The method according to claim 5 wherein said minimum prediction order is between 5 and 8 for the upper sub-band and between 10 and 15 for the lower sub-band, and the maximum prediction order is between 15 and 20 for the upper sub-band and is between 50 and 60 for the long sub-band, respectively.

7. The method defined in claim 2 wherein said first threshold is between 1.001 and 1.01 and said second threshold is between 1 and 2.

8. The method according to claim 7 wherein the values of the first and the second threshold lie within the second half of the respective intervals.

9. A device for coding/decoding audio signals by means of analysis-by-synthesis techniques, in which synthesis filters in a coder and in a decoder and perceptual weighting filters in the coder are associated with spectral parameter adaptation units, which perform this adaptation for each sample block of the speech signal to code or for each coded signal to decode for reconstructing a block of samples, said adaptation units of spectral parameters also supplying parameters determined for a block of samples to be coded or respectively for a signal to be decoded to an adaptation unit of prediction order of the filters which unit updates this prediction order starting from the spectral characteristics of the reconstructed signal, with the following operations:

a) calculating, in function of the prediction order and up to a predetermined maximum order, the prediction gain of the synthesis filters (SYC, SYD) which generate the reconstructed signal, and their incremental prediction gain when the prediction order is increased by one unit, said gains being given respectively by the following relations:

$$G(p) = 1/\prod_{J=1}^{p}(1 - KJ^2)$$

$$G(p/p-1) = \prod_{J=1}^{p-1}(1 - KJ^2)/\prod_{J=1}^{p}(1 - KJ^2)$$

where KJ are the reflection coefficients of the acoustic tube;

b) determining, in a prediction order interval between a minimum order and said maximum order, the values for which the incremental gain G(p/p−1) presents a relative maximum and is greater than a first predetermined threshold;

c1) carrying out the synthesis and weighting filtering with the highest prediction order among those determined at point b), if the gain corresponding to the maximum prediction order is not less than a second predetermined threshold; and c2) carrying out the synthesis and weighting filtering using the minimum prediction order, if the gain corresponding to the maximum prediction order is less than a second predetermined threshold.

10. A device according to claim 9 wherein said filters are lattice filters, and the spectral parameter adaptation units supply the reflection coefficients of an acoustic tube, determined with adaptive lattice techniques.

11. A device according to claim 9 wherein the synthesis filters in the coder and in the decoder receive, as excitation signals, vectors scaled with a gain consisting of a first factor $\beta_v$ typical of the vector and of a second factor $\beta_m$ which takes account the average power of the signal to be coded, and in that means are also provided for performing, for each block of samples to be coded or for each coded signal to be decoded, an adaptation of said second factor $\beta_m$, with adaptive lattice techniques, starting from the optimum innovation vector ($e_{xo}$) scaled with the total gain, identified for coding the previous block of samples or used for decoding a previous signal.

12. A device according to claim 9 for coding wide-band signals, including means for dividing the signal band into at least two sub-bands, and individual coders and decoders for each sub-band, the weighting and synthesis filters in the coder and the decoder of the upper band having a prediction order which is made to vary by the adaptation unit between a minimum value of 5–8 and a maximum value of 15–20, and the weighting and synthesis filters in the coder and the decoder of the lower band have a prediction order which is made to vary by the adaptation unit between a minimum value of 10–15 and a maximum value of 50–60.

13. A device according to claim 12 wherein the coders of the different sub-bands are associated with means to dynamically share the coding bits among the sub-bands, for each block of samples to be coded, so as to minimize the total distortion, taking account also of the distortion introduced by the perceptual weighting filters.

* * * * *